United States Patent [19]

Dekanic

[11] 3,930,704

[45] Jan. 6, 1976

[54] WALL SOCKET

[76] Inventor: Dinko Dekanic, Strandsnasgatan 4, 330 23 Smalandsstenar, Sweden

[22] Filed: June 18, 1974

[21] Appl. No.: 480,528

[30] Foreign Application Priority Data

June 20, 1973 Sweden ..... 7308674

[52] U.S. Cl. ..... 339/42

[51] Int. Cl.[2] ..... H01R 13/44

[58] Field of Search ..... 339/40, 42, 66 R, 66 M, 339/195, 196

[56] References Cited

UNITED STATES PATENTS

| | | | |
|---|---|---|---|
| 1,171,914 | 2/1916 | Wright | 339/42 |
| 1,522,574 | 1/1925 | Benjamin | 339/195 R |
| 2,155,925 | 4/1939 | Blinn | 339/40 X |
| 2,579,538 | 12/1951 | Bierce | 339/40 |
| 3,736,547 | 5/1973 | Koenig | 339/40 X |

FOREIGN PATENTS OR APPLICATIONS

| | | | |
|---|---|---|---|
| 169,521 | 11/1951 | Germany | 339/42 |
| 178,990 | 4/1962 | Sweden | 339/42 |

*Primary Examiner*—Joseph H. McGlynn
*Assistant Examiner*—Craig R. Feinberg
*Attorney, Agent, or Firm*—Albert L. Jeffers; Roger M. Rickert

[57] ABSTRACT

A wall socket of the "pick-safe" type to prevent or at least make it difficult for children to come into contact with the electrical conducting contacting members of the wall socket wherein the contacting members are arranged to be movable between an inoperative position, where they are inaccessible from the openings of the socket, to an operative contact position which includes a guiding arrangement to guide the contacting members to the operative position when connecting the plug to the socket, and to an inoperative position, when removing the plug from the socket.

7 Claims, 5 Drawing Figures

WALL SOCKET

BACKGROUND OF THE INVENTION

1. Field of the Invention

This invention relates to a wall socket or the like, which is of the "pick-safe" type, i.e. having special arrangements to prevent or at least to make it difficult for children to come into contact with the electrical conducting contacting members of the wall socket.

2. Description of the Prior Art

Known wall sockets of the pick-safe type are shaped according to the principle, that the openings in the casing of the socket, to which the electrical contact pins of the plug are being introduced for coming into contact with the contacting members of the socket, are covered with spring loaded covering plates. However, said known pick-safe sockets are not absolutely safe, as even relatively small children can learn to control said covering plates to uncover the access openings of the socket and by that can come into contact with the contacting members of the socket.

SUMMARY OF THE INVENTION

Therefore, the object of the present invention is to provide an improved wall socket of the pick-safe type, with the possibility for a child to establish contact with the contacting members of the socket without using a plug, almost does not exist.

To meet that object is the socket according to the invention characterized by that the contacting members of the socket are arranged movable between a position, where they are inaccessible through the access openings of the socket, and an operative contact position, and by a guiding arrangement, which is arranged to be influenced by the body of the plug to guide the contacting members to an operative position, when connecting the plug to the socket, and to an inoperative position, when removing the plug from the socket.

Preferably the guiding arrangement consists of devices movably arranged in the body of the socket, said devices are moved under compression of a spring and guiding the contacting members of the socket from an inoperative to an operative position by means of cam surfaces.

Preferably said guiding devices are so designed, that the contacting members in their inoperative position are received into recesses in the guiding devices to be almost inaccessible for attaching through the openings in the casing of the socket.

BRIEF DESCRIPTION OF THE DRAWINGS

In the following the invention will be more described with reference to the accompanying drawings.

DESCRIPTION OF THE PREFERRED EMBODIMENT

Figure 1:
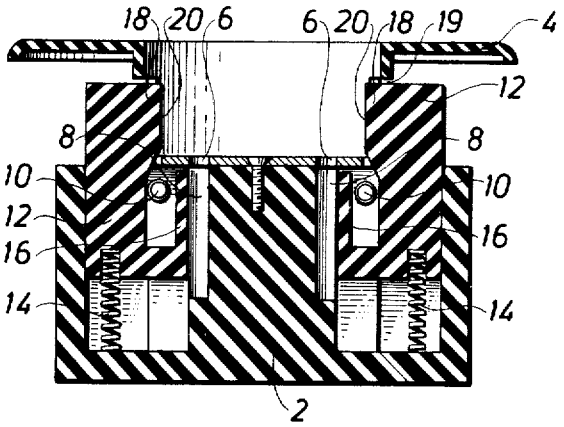
FIG. 1 shows a cross-section through one wall socket according to the invention.
Figure 2:
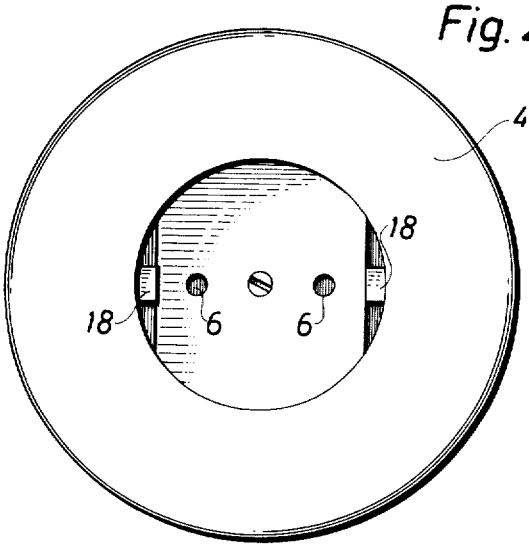
FIG. 2 illustrates the socket in a front view.
Figure 3:
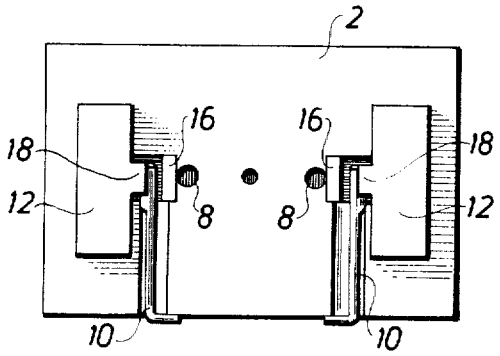
FIG. 3 illustrates the socket in the same view as shown in FIG. 2 of the socket, but with the casing removed.
Figure 4:
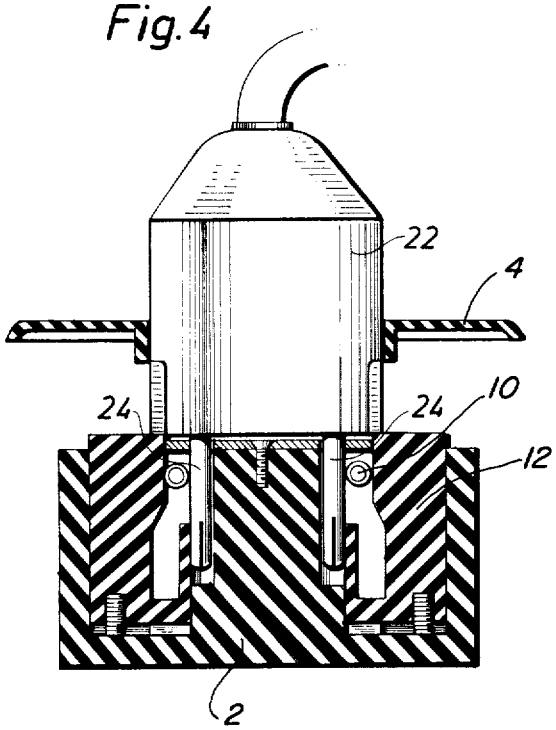
FIG. 4 illustrates the socket in a view similar to FIG. 1 with the plug inserted; and, FIG. 5 shows a cross-section through a socket according to another design of the invention.

The wall socket in accordance with FIGS. 1–4 comprises a body 2, in which slots are arranged for receiving different functional elements of the socket. The body 2 is formed with a casing design as a cap 4. Openings 6 and 8 respectively are arranged in the cap 4 and into the body 2, whereby the contacting pins of a plug are meant to enter said openings. The contacting members 10 are supported by the body 2 in such a way, that they are laterally movable under spring control and strive to take the position shown in FIG. 1. Guiding devices are also arranged into the body, whereby said devices are movable towards and from the cap 4 under guiding control of the body 2. The guiding devices 12 are pressed by springs 14 towards the position shown in FIG. 1. Further, the guiding devices 12 are provided with a tongue 16, which forms recesses into the guiding devices, and the contacting members 10 are received into said recesses in the position shown in FIG. 1.

Thus, it is not possible to touch the contacting members 10 of the socket through the openings 6 in the cap 4, when the guiding devices 12 are situated in the position shown in FIG. 1.

Each of the guiding devices 12 has a projection 18, which are projected through an aperture 19 in the cap 4. When a plug is introduced into the socket, the body of the plug will engage the projections 18 of the guiding device 12 and under action of the springs 14 press the guiding devices towards the interior of the socket. (See FIG. 4) In this connection the surfaces 20 of the projections 18, which forms cam surfaces, are moved to engagement with the contacting members 10, which are laterally pressed inwardly towards the openings 8 into the body 2 of the socket, whereby the contacting members will engage the pins 24 of the plug 22.

Thus, the contacting members 10 are moved between an operative and an inoperative position by means of the body of the plug, and consequently it is not sufficiently to establish contact with the contacting members of the socket only by entering a pointed object through the openings of the socket, which is possible when using known sockets of the pick-safe type.

Naturally, it is possible to make the socket more safe by providing the socket with a locking device, which cooperates with the guiding devices, so both guiding devices simultaneous have to be acted, for a pressing operation of the guiding devices into the body shall take place and by that move the contacting members to an operative position.

Figure 5:
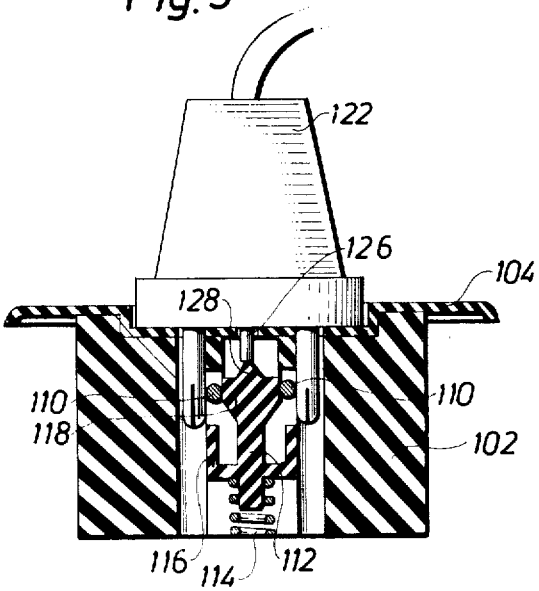

Another embodiment of the invention is shown in FIG. 5. This embodiment shows that only one guiding device 112 is enclosed in the body 102. A spring 114 is actuating on said guiding device, and the contacting members 110 of the socket is actuated by projections 118 of the guiding body 112. The guiding body 112 is provided with two lugs 116, which, like the lugs 16 in the embodiment described above, forms recesses for receiving the contacting members in their inoperative position. According to the embodiment in accordance with FIG. 5, the guiding device 112 is actuated by a pin 126 designed on the plug 122, whereby said pin is adapted to enter through an opening in the cap 104, when introducing the plug into the socket and actuating on the guiding device 112.

The guiding device 112 is pointed at 128, which point is projected through the opening in the cap 104, when the plug 122 is removed. A child, which with its finger tries to press the guiding device into the body, is pricking the finger on the point 128.

A core can be arranged or molded into the guiding device 112 for grounding the socket. Another way is to arrange or mold a metal casing into the body 102 in connection with the area for the entering of the pin 126 into the socket and with a screw as adapter. The pin 126 can in this connection be arranged to be pressed past the metal socket, when the plug 122 is entered into the socket, for example by the way, that the pin is showing a preformed resilient part, which is preferably preformed in one piece with the pin.

The invention can be modified in a multiplicity of ways within the scope of the following claims.

I claim:

1. A wall socket having at least one opening into which an electrical contact pin of a plug may be introduced to make electrical contact therein comprising:

a socket body;

at least one guiding device;

means movably supporting the guiding device within the socket body for limited movement in the general direction of plug introduction;

at least one cam surface on the guiding device;

at least one contacting member movable between an inoperative position where it is inaccessible from the socket opening and an operative contact position;

means for supporting and springingly urging the contacting member lateral to the direction of plug introduction;

a lug integral with the guiding device and forming in conjunction therewith a recess;

the contacting member being housed within the recess of the guiding device when in the inoperative position; and means responsive to the introduction of a plug into the wall socket to force, by way of the cam surface, the contacting member into contact with the plug pin.

2. A wall socket in accordance with claim 1 further comprising spring biasing means for urging the guiding device toward the at least one opening and therefore also the contacting member into the guiding device recess.

3. A wall socket in accordance with claim 1 wherein there is one guiding device and two contacting members, the socket further including an additional lug integral with the guiding device and forming in conjunction therewith an additional recess for receiving the other of the contacting members in the inoperative position.

4. A wall socket in accordance with claim 3 wherein the plug is provided with two pins for making electrical contact with respective contacting members and a guiding device actuating pin, the socket having two electrical contact pin openings and a guiding device actuating pin opening whereby, when the plug is introduced into the socket, the guiding device actuating pin engages the guiding device to move the guiding device in the direction of plug insertion thereby freeing the contacting members from their respective recesses.

5. A wall socket in accordance with claim 1 wherein there are two guiding devices and two associated contacting members supported within the socket body to provide a socket for accepting a dual pin plug.

6. A wall socket in accordance with claim 5 wherein the socket has two pin accepting openings and further comprising spring biasing means for independently urging the two guiding devices toward the pin accepting openings and therefore also the contacting members into their respective guiding device recesses.

7. A wall socket in accordance with claim 6 wherein a portion of each guiding device is exposed for engagement with a plug whereby introduction of the plug into the socket forces each guiding device against its respective bias urging to force the contacting members from their respective guiding device recesses and into contact with the plug pins.

* * * * *